United States Patent [19]

Hochlehnert et al.

[11] Patent Number: 4,627,318

[45] Date of Patent: Dec. 9, 1986

[54] METHOD OF AND APPARATUS FOR GAPPING A SLIDE-FASTENER TAPE

[75] Inventors: Franz Hochlehnert, Essen; Werner Rademacher, Essen-Kettwig; Lothar Grosskreuz, Dortmund, all of Fed. Rep. of Germany

[73] Assignee: Opti Patent-, Forschungs- und Fabrikations-AG, Riedern-Allmeind, Switzerland

[21] Appl. No.: 808,889

[22] Filed: Dec. 13, 1985

[30] Foreign Application Priority Data

Dec. 15, 1984 [DE] Fed. Rep. of Germany ..... 3445865

[51] Int. Cl.[4] ..... B26D 7/02; B26D 7/14

[52] U.S. Cl. ..... 83/18; 29/33.2; 29/408; 29/770; 83/175; 83/389; 83/921

[58] Field of Search ..... 83/18, 175, 921, 389; 29/33.2, 408, 770

[56] References Cited

U.S. PATENT DOCUMENTS 3,831,474 8/1974 Perlman ..... 83/921 X
4,378,715 4/1983 Kaiser et al. ..... 83/175 X

FOREIGN PATENT DOCUMENTS 2360947 6/1974 Fed. Rep. of Germany .
775407 5/1957 United Kingdom ..... 83/921

*Primary Examiner*—Frank T. Yost
*Attorney, Agent, or Firm*—Karl F. Ross; Herbert Dubno

[57] ABSTRACT

A slide-fastener assembly comprising a pair of longitudinally extending and parallel tapes having adjacent edges carrying respective coupling coils that form coupling heads and that are interleaved with one another is gapped by advancing the assembly in steps through a punching location, engaging the coils upstream and downstream of the location by respective upstream and downstream grippers and holding the assembly stationary in the station between steps, and punching the heads off the coils between the grippers while the assembly is held stationary in the station. The grippers are displaced apart to longitudinally tension the coils after engaging the grippers with the coils and before punching the heads off the coils. Thus the upstream gripper is displaced upstream and the downstream gripper downstream, slightly stretching and tensioning the tape assembly.

9 Claims, 3 Drawing Figures

METHOD OF AND APPARATUS FOR GAPPING A SLIDE-FASTENER TAPE

FIELD OF THE INVENTION

The present invention relates to a method of and apparatus for making a slide fastener. More particularly this invention concerns the punching out of coupling heads from a slide-fastener tape assembly, a procedure known as gapping.

BACKGROUND OF THE INVENTION

In the production of a slide fastener a pair of coupling elements typically formed as helicoidal chains are secured to the edges of respective tapes and are interleaved. The coupling elements are then punched out at longitudinally spaced locations. Then the end stop members and slider are mounted on the coupling elements and the tape assemblies are cut at the punch locations to form individual slide fasteners.

The tape assembly comprising the tapes with the interleaved coupling elements is moved in steps through a gapping machine of the type described in German patent document No. 2,360,947 filed by Kihei Takahashi with a claim to a Japanese priority date of Dec. 6, 1972. Here the coupling elements are engaged by upstream and downstream elements that position them underneath a punch that moves down to cut the heads off the interleaved turns of the coupling elements. The half turns left on the tapes are then stripped therefrom by means of laterally effective rakes.

It is essential that entire coupling heads be removed, that no partial heads be left on the tapes. Thus this German patent document teaches that the positioning device comprises upstream and downstream gripper fingers that are pushed down onto the coupling elements, then pushed together to longitudinally compact and compress the tape assembly. The intent of such a procedure is to compress the coupling chains in such a manner that a whole number of heads are positioned under the punch and therefore no partial heads are left.

In this arrangement, however, the compressibility of the coupling elements and the tapes carrying them can vary considerably. The result is, of course, nonuniform compression and the occasional chopping of coupling heads in half, spoiling the entire fastener.

Another disadvantage results from the way the grippers move vertically down onto the coupling elements and then move longitudinally toward each other. When the pins or fingers of the grippers do not engage between turns of the coupling elements but instead land directly atop the turns of the coils, the grippers can slip slightly when pushed together, resulting in a misfeed that can produce an improperly chopped chain.

OBJECTS OF THE INVENTION

It is therefore an object of the present invention to provide an improved gapping apparatus and method.

Another object is the provision of such a gapping apparatus and method which overcomes the above-given disadvantages, that is which invariably positions the coupling elements and tapes under the punch so that only whole coupling heads are cut from them.

SUMMARY OF THE INVENTION

A slide-fastener assembly comprising a pair of longitudinally extending and parallel tapes having adjacent edges carrying respective coupling coils that form coupling heads and that are interleaved with one another is gapped by advancing the assembly in steps through a punching location, engaging the coils upstream and downstream of the location by respective upstream and downstream grippers and holding the assembly stationary in the station between steps, and punching the heads off the coils between the grippers while the assembly is held stationary in the station. According to this invention the grippers are displaced apart to longitudinally tension the coils after engaging the grippers with the coils and before punching the heads off the coils. Thus the upstream gripper is displaced upstream and the downstream gripper downstream, slightly stretching and tensioning the tape assembly.

Such an arrangement ensures perfect positioning of the coupling heads under the punch. There will therefore never by any partial heads left on the tapes, so that no fasteners will be spoiled. This method works very accurately, allowing the gapping machine to cycle quickly.

According to another feature of this invention the gripper have pin ends that can engage between turns of the coupling coils and these grippers are spring mounted for limited free longitudinal movement. Thus as the grippers move down on the tape assembly their ends can move longitudinally to fit between the turns thereof. This arrangement further increases the speed with which the machine can operate.

Thus the apparatus of this invention comprises a drive for advancing the tape assembly in steps through a punching location, respective upstream and downstream grippers engageable between the turns of the coils upstream and downstream of the location, a vertically displaceable punch at the location between the grippers, and actuators for vertically displacing the punch between advance steps of the assembly for punching out the coils between the grippers and for displacing the grippers apart to longitudinally tension the coils after engaging the grippers with the coils and before punching the heads off the coils.

In accordance with further features of the invention the grippers are pivotal about respective horizontal axes extending transversely of the tape assembly. In addition the punch carries respective upstream and downstream pins extending along and defining the axes and the grippers are formed with vertically elongated horizontally and transversely throughgoing slots through which the respective pins project. Upstream and downstream stops engage oppositely away from the location with the grippers and define a minimum spacing therebetween. These stop can be longitudinally displaced to adjust the end positions of the grippers. The grippers are provided with rollers riding on the respective stops.

DESCRIPTION OF THE DRAWING

The above and other features and advantages will become more readily apparent from the following, reference being made to the accompanying drawing in which.

SPECIFIC DESCRIPTION

Figure 1:
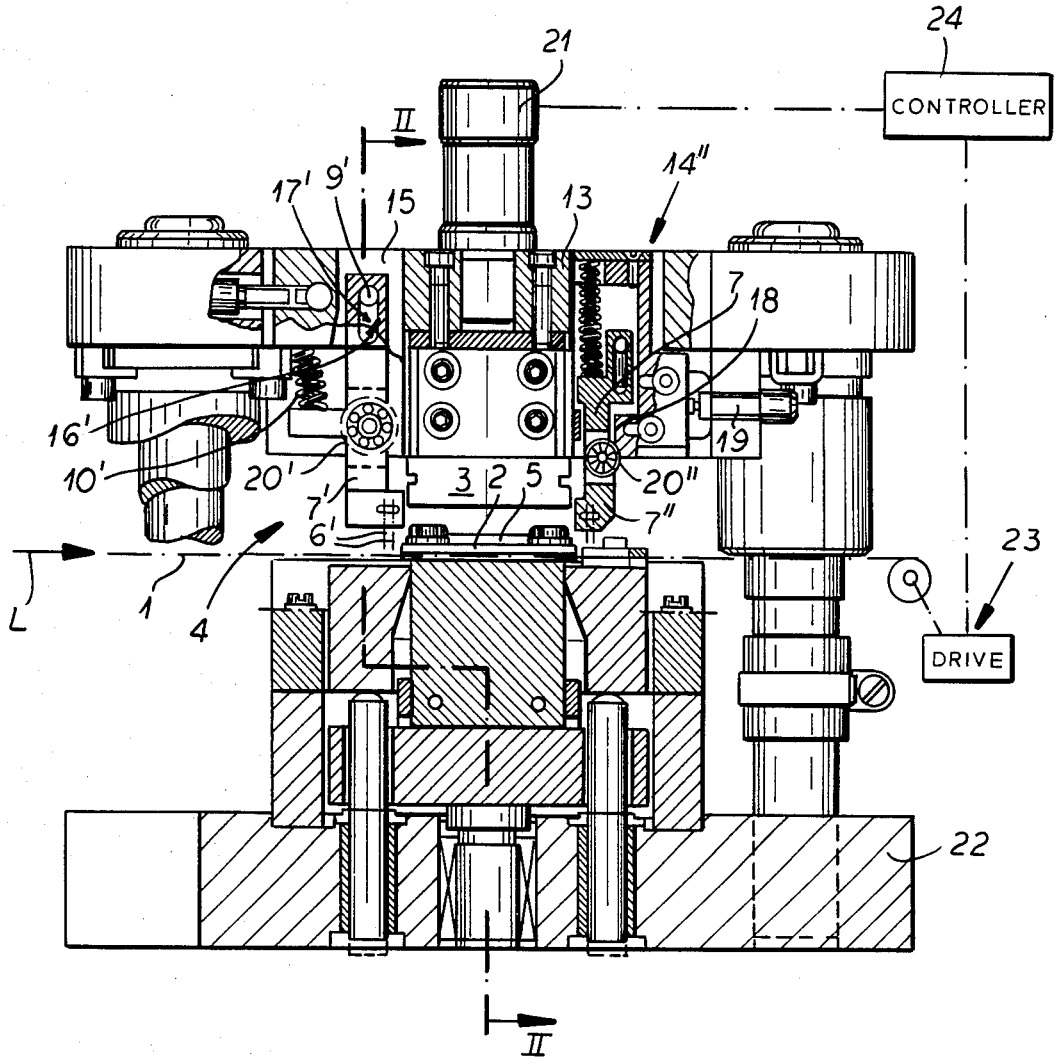
FIG. 1 is a partly schematic side view of the apparatus of this invention.
Figure 2:
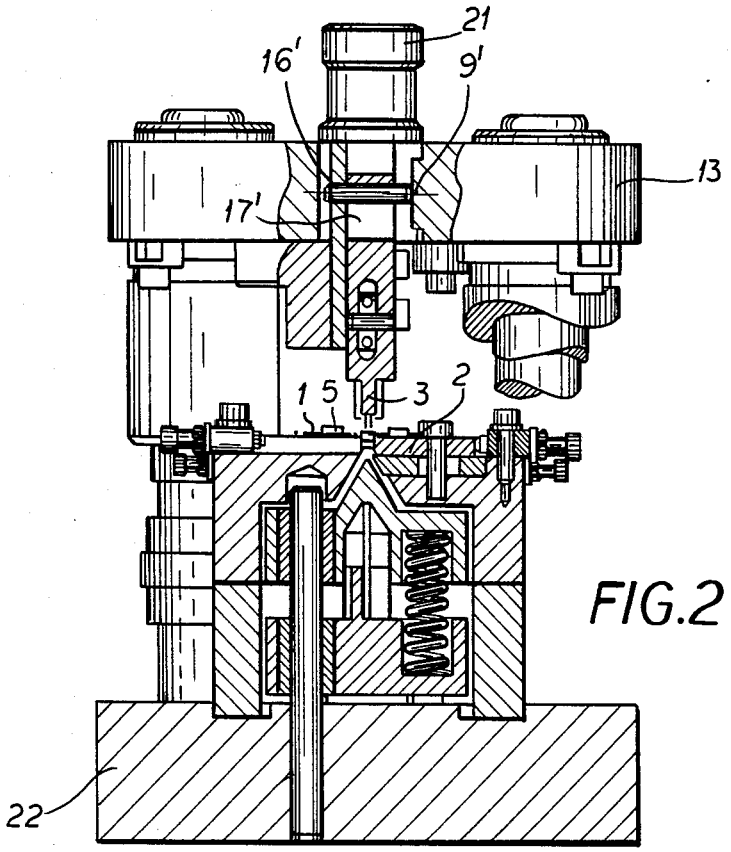
FIG. 2 is a vertical section taken along line II—II of FIG. 1.
Figure 3:
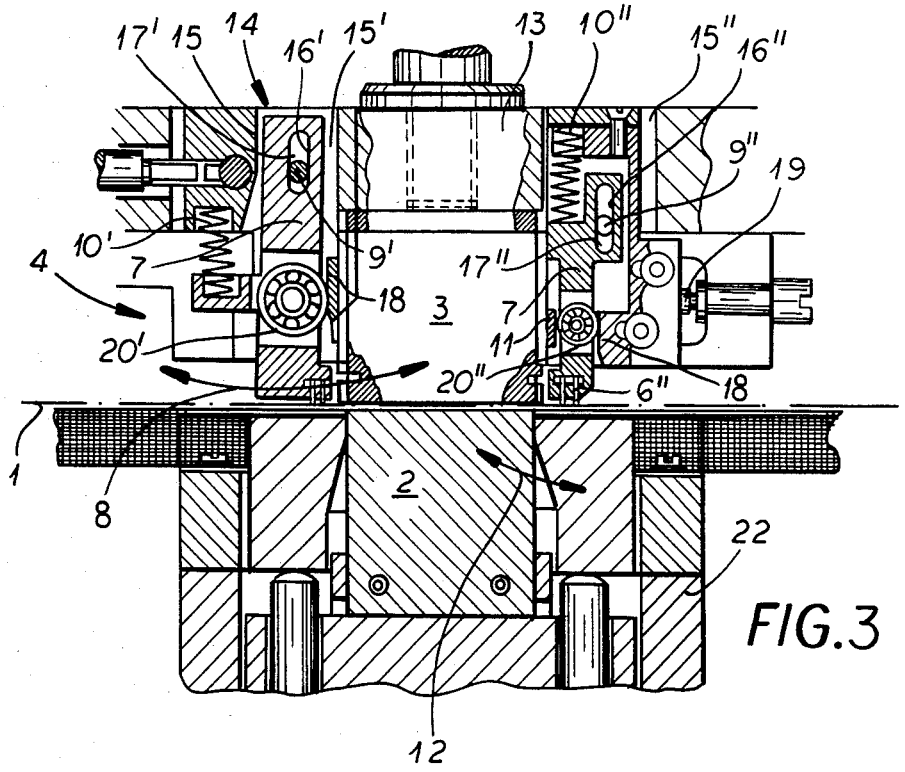
FIG. 3 is a large-scale view of a detail of FIG. 1.

As seen in the drawing the method of the instant invention is carried out by a machine having a frame 22 carrying a die 2 and a traverse 13 with a punch 3 vertically and transversely engageable with the die 2. A guide 5 defines a longitudinal travel direction L for a slide-fastener tap assembly shown at dot-dash line 1 and comprising as is known a pair of textile tapes having adjacent edges provided with coupling coils with interleaved turns. A drive illustrated schematically at 23 in FIG. 1 is connected via a controller 24 with an actuator 21 for synchronous stepwise advance of the tape 1 and vertical reciprocation of the punch 3.

The tape 1 is accurately located in the guide 5 under the punch 3 by a positioning unit 4 comprising an upstream gripper 7' and a downstream gripper 7'' having respective pins or fingers 6' and 6'' that can poke between the turns of the coupling coils of the tape 1. These grippers 9' and 9'' are limited vertically and longitudinally displaceable in respective guides 14' and 14'' formed on the traverse and are both vertically and longitudinally controlled by the vertical movement of the punch 3, being limitedly pivotal about respective horizontal and transverse axes 9' and 9''.

To this end the traverse is formed with upstream and downstream guide slots 15' and 15'' and the punch 3 carries upstream and downstream horizontal pins 16' and 16'' transversely bridging these guides 15' and 15'' and passing through vertically elongated slots 17' and 17'' formed in the grippers 7' and 7''. Compression springs 10' and 10'' are vertically braced between the frame 22 and the grippers 7' and 7'' to urge their lower ends toward each other. Finally, these grippers 7' and 7'' carry respective rollers 20' and 20'' that ride respectively on a cam 18 and on guides 11 and 18, the latters' position being longitudinally adjustable by a unit 19.

The vertical dimension of the slots 17' and 17'' is such that when the punch 3 which carries the pins 16' and 16'' is lifted all the way up as seen in FIG. 1 the pins 6' and 6'' are pulled well up away from the tape 1'. When lowered all the way, however, the pins 6' and 6'' engage between the coils of the tape 1. The spring mounting of the grippers 7' and 7'' with the possibility of limited outward movement against the force of their springs 10' and 10'' insures that even if the pins 6' and 6'' land directly atop a turn of a coil of the tape, they will shift somewhat outward to pass between turns, thereby preventing subsequent slip.

In addition as the punch lowers the cam 18 carried by it pushes the upstream gripper 7' upstream, away from the downstream gripper 7''. This spreading of the grippers 7' and 7'' takes place after the pins 6' and 6'' are well engaged in the tape 1. Thus the tape will be stretched slightly, just enough to ensure that the punch 3, whose longitudinal length is exactly calculated to be a whole-number multiple of the length of an individual coupling head, will cut off whole coupling heads, leaving no partial heads behind.

We claim:

1. In a method of gapping a slide-fastener assembly comprising a pair of longitudinally extending and parallel tapes having adjacent edges carrying respective coupling coils that form coupling heads and that are interleaved with one another, the method comprising the steps of:

advancing the assembly in steps through a punching location;

engaging the coils upstream and downstream of the location by respective upstream and downstream grippers and holding the assembly stationary in the station between steps; and punching the heads off the coils between the grippers while the assembly is held stationary in the station, the improvement comprising the step of displacing the grippers apart to longitudinally tension the coils after engaging the grippers with the coils and before punching the heads off the coils.

2. The method defined in claim 1 wherein the gripper have pin ends that can engage between turns of the coupling coils, the method further comprising the step of spring-mounting the grippers for limited free longitudinal movement, whereby the gripper ends can move longitudinally when engaged down on the coils to fit between the turns thereof.

3. An apparatus for gapping a slide-fastener assembly comprising a pair of longitudinally extending and parallel tapes having adjacent edges carrying respective coupling coils that form coupling heads and that are interleaved with one another, the apparatus comprising:

means for advancing the assembly in steps through a punching location;

respective upstream and downstream grippers engageable between the turns of the coils upstream and downstream of the location;

a vertically displaceable punch at the location between the grippers;

means for vertically displacing the punch between advance steps of the assembly for punching out the coils between the grippers; and means for displacing the grippers apart to longitudinally tension the coils after engaging the grippers with the coils and before punching the heads off the coils.

4. The apparatus defined in claim 3 wherein the gripper have pin ends that can engage between turns of the coupling coils, the apparatus further comprising means including springs supporting the grippers for limited free longitudinal movement, whereby the gripper ends can move longitudinally when engaged down on the coils to fit between the turns thereof.

5. The apparatus defined in claim 3 wherein the grippers are pivotal about respective horizontal axes extending transversely of the tape assembly.

6. The apparatus defined in claim 5 wherein the punch carries respective upstream and downstream pins extending along and defining the axes and the grippers are formed with vertically elongated horizontally and transversely throughgoing slots through which the respective pins project.

7. The apparatus defined in claim 3, further comprising upstream and downstream stops engaging oppositely away from the location with the grippers and defining a minimum spacing therebetween.

8. The apparatus defined in claim 7, further comprising means for longitudinally displacing the stops and thereby adjusting the ed positions of the grippers.

9. The apparatus defined in claim 7 wherein the grippers are provided with rollers riding on the respective stops.

* * * * *